United States Patent [19]

Buckwitz et al.

[11] Patent Number: 4,854,147

[45] Date of Patent: Aug. 8, 1989

[54] WIRE PINCH MARK APPLICATOR

[75] Inventors: Richard J. Buckwitz, Issaquah; Alfred E. Walter, Jr., Everett, both of Wash.

[73] Assignee: The Boeing Company, Seattle, Wash.

[21] Appl. No.: 140,868

[22] Filed: Dec. 28, 1987

Related U.S. Application Data

[63] Continuation of Ser. No. 843,307, Mar. 24, 1986, abandoned.

[51] Int. Cl.[4] ..... B21F 23/00

[52] U.S. Cl. ..... 72/7; 72/196; 72/198

[58] Field of Search ..... 29/335; 72/7, 186, 196, 72/198, 444; 83/287, 295, 335; 140/105; 400/127, 128

[56] References Cited

U.S. PATENT DOCUMENTS

| | | | |
|---|---|---|---|
| 1,607,432 | 11/1926 | Bryce . | |
| 1,910,278 | 5/1933 | Browning | 101/6 |
| 1,956,951 | 5/1934 | Hinsky | 173/264 |
| 2,626,302 | 1/1953 | Cox | 174/113 |
| 2,745,436 | 5/1956 | Battle et al. | 138/47 |
| 3,193,614 | 7/1965 | Richards | 174/112 |
| 3,197,554 | 7/1965 | Baker | 174/112 |
| 3,319,051 | 5/1967 | Renold | 235/61.11 |
| 3,333,534 | 8/1967 | Dedek et al. | 101/6 |
| 3,628,410 | 12/1971 | Shields | 83/335 |
| 3,663,359 | 5/1972 | Braim | 162/105 |
| 3,745,864 | 7/1973 | Watson | 83/295 |
| 3,803,962 | 4/1974 | Koslow | 83/335 |
| 3,982,454 | 9/1976 | Schneider et al. | 83/287 |
| 4,158,976 | 6/1979 | Ditges | 83/287 |
| 4,165,665 | 8/1979 | Shimizu et al. | 83/287 |
| 4,363,271 | 12/1982 | Horst | 101/181 |
| 4,383,435 | 5/1983 | Hinzmann | 73/37.7 |

FOREIGN PATENT DOCUMENTS

| | | | |
|---|---|---|---|
| 744070 | 10/1966 | Canada . | |
| 1515482 | 8/1969 | Fed. Rep. of Germany . | |
| 1808801 | 6/1970 | Fed. Rep. of Germany . | |
| 2557488 | 6/1977 | Fed. Rep. of Germany . | |
| 39332 | 3/1980 | Japan | 101/6 |
| 1067340 | 5/1967 | United Kingdom . | |

*Primary Examiner*—Lowell A. Larson

*Attorney, Agent, or Firm*—Christensen, O'Connor, Johnson & Kindness

[57] ABSTRACT

Apparatus for applying a pinch mark to a wire (10) at a selected target position along the length of the wire. The apparatus operates in response to a first signal (MARK) indicating that the target position is at a known upstream location. The apparatus includes pinch means (44) including dies (54,56) mounted for movement to and from a pinch station along the wire path. The apparatus includes coupling means responsive to the first signal for causing the dies to move to the pinch station when the target position is at the pinch station. The coupling means may comprise a servo motor (60), control means (70) for driving the servo motor at a selected speed with respect to the wire speed, and engagement means (62,64) responsive to the first signal for coupling the dies to the servo motor such that the dies and the target position arrive at the pinch station at the same time and traveling at the same speed. The dies thereby exert a minimum lengthwise force on the wire. A reset system(66) is provided for returning the dies to a predetermined reset position after each pinch mark is applied. The engagement means may comprise a single revolution clutch.

20 Claims, 5 Drawing Sheets

WIRE PINCH MARK APPLICATOR

This application is a continuation application based on prior copending application Ser. No. 843,307, filed Mar. 24, 1986, now abandoned.

FIELD OF THE INVENTION

The present invention is directed to a device for applying pinch marks to wire while the wire is moving in a lengthwise direction. Such a device is particularly useful in conjunction with an ink jet wire coding device, to thereby apply both wire identification codes and pinch marks to wire that is moving rapidly between an input spool and an output spool. The coding is intended to identify each piece of wire on the continuous output spool by its part number. The pinch marks provide an easily recognizable designation of where one piece of wire ends and the next one begins along the continuous length of wire.

BACKGROUND OF THE INVENTION

A modern jet aircraft typically includes several hundred multi-wire harnesses for electrically connecting various aircraft subsystems. Such harnesses can conveniently be broken down into two types, integration harnesses and ships harnesses. Integration harnesses are comparatively short but include a large number of individual wires and typically a large number of branch points. Ships harnesses typically comprise a small numer of long wires.

Under current technology, different manufacturing methods are used for integration and ships harnesses. The first step in forming an integration harness is to run raw wire through a wire coding machine, such as the wire coding machine available from Conrac, or an equivalent device. The Conrac machine operates under the control of a computer that includes a data base specifying the lengths and code numbers of the individual wires required for a set of harnesses. The Conrac machine provides instructions to the operator concerning the type of raw wire to be mounted on an input spool, and then unreels, codes and places pinch marks on the wire as the wire is transferred from the input spool onto an output spool. Coding is accomplished by a hot stamp process in which identifying code symbols (e.g., numbers) are printed on the wire insulation. The pinch mark mechanism of the Conrac machine requires the wire to be stationary when the pinch mark is applied. The Conrac machine can also cut the wire rather than pinch it. The cutting mechanism also requires the wire to be stationary when the cut is made.

The wire spools coded and pinched by the Conrac machine may be further processed using a computer aided, hand-forming (CAHF) system. In a CAHF system, a formboard is created for each cable, the formboard comprising a planar baseboard, a drawing attached to the baseboard with imprinted instructions and diagrams relating to wire routing, and pegs projecting above the baseboard around which wire can be routed or to which wire can be tied off. In response to instructions displayed on a portable computer monitor, a CAHF operator unreels coded and pinched wires from the spools produced by the Conrac machine, and winds such wires on the formboard pegs, using the codes and pinch marks to verify correct placement. The continuous wire is cut inboard of the pinch marks at the connector cut line indicated on the drawing attached to the baseboard, such that all pinch marks are removed from the completed wire harness.

Under present technology, ships harnesses are typically created by a conventional lay-down process. In such a process, a Conrac machine is first used to code and cut individual wires. For efficiency, a Conrac operator loads a given wire type on the input spool of the Conrac machine, and then codes and cuts all wire segments that will be required from that reel for a given set of harnesses, the set of harnesses typically corresponding to one day's work. After each wire segment has been coded and cut, the operator manually coils the cut wire and places it in an output group corresponding to a given harness and harness subassembly. When the Conrac operator has collected a complete set of wires for a given harness, these wires are then routed to a follow on stage that applies a connector to one end of the harness. The harness with the connector on one end is then laid out on a conventional formboard, and then processed through a station that applies a connector to the other end of the harness.

In recent years, ink jet machines have become available that are capable of applying codes to wire while the wire is moving rapidly through the machine, at speeds up to 350 feet per minute. Ink jet machines therefore make possible a high speed, spool-to-spool, wire coding process in which wire is continuously unwound from an input spool, coded in the ink jet machine, and rewound onto an output spool. The ink jet machine identifies the beginning and ending of each wire segment with a block mark that comprises a pair of closely spaced bars. The block mark indicates the boundary between adjacent wire segments, and the small space between the bars for a block mark is the intended cut line. Unless multiples of the same wire are being coded, the code applied to each wire segment changes with each block mark.

SUMMARY OF THE INVENTION

The present invention provides an apparatus that is capable of applying pinch marks to wire moving at high speed. The device is particularly suited for use with an ink jet marking machine. In a typical arrangement, wire is unwound from an input spool, passed through the ink jet marker and the pinch mark applicator of the present invention, and is then wound onto an output spool. By such a technique, both codes and pinch marks can be applied to a wire spool at a rate much higher than that attainable with prior art sytems.

In a preferred embodiment, the present invention provides an apparatus for applying a pinch mark to a selected target position along the length of a moving wire. The apparatus operates in response to a first signal indicating the target position. The apparatus includes pinch means including a die mounted for movement to and from a pinch station along the wire path. The pinch means is adapted when at the pinch station to apply a pinch mark to the wire. The apparatus further includes coupling means responsive to the first signal for causing the die to move to the pinch station, such that the die is at the pinch station when the target position on the wire is at the pinch station.

In a preferred aspect, the coupling means of the present invention includes means for controlling the movement of the die to the pinch station such that the die arrives at the pinch station moving at substantially the same speed and in substantially the same direction as the wire. The coupling means may comprise a servo motor and control means for driving the servo motor at a selected speed with respect to the wire speed. The coupling means may also include engagement means responsive to the first signal for coupling the die to the servo motor, such that the die and the target position arrive at the pinch station at the same time and travelling at the same speed, such that the die exerts a minimum lengthwise force on the wire. The engagement means may comprise a single revolution clutch, and timing means for actuating the clutch at an appropriate time. The timing means begins timing upon receipt of the first signal for a duration dependent on the second signal, and actuates the clutch at the end of the duration. The pinch means preferably comprises first and second pinch members mounted for rotation about spaced-apart, parallel axes, and first and second dies respectively mounted on the pinch members. The pinch means also includes means for coupling the rotation of the pinch members, such that one die is at the pinch station when the other die is at the pinch station.

The apparatus of the present invention also preferably includes reset means for returning the die to a predetermined reset position after each revolution of the clutch means. Preferably, the reset means is active only when the wire speed is below a predetermined threshold. The timing means preferably comprises a counter for storing a variable count value, means for loading the counter with a preset count value, means responsive to the receipt of the first signal to enable the counter to vary the count value at a rate corresponding to the wire speed, and means responsive to the count value reaching a predetermined value for actuating the clutch means. The timing means may comprise a plurality of counters, and means for sequentially enabling the counters in response to sequentially received first signals.

DETAILED DESCRIPTION OF THE INVENTION

Figure 1:
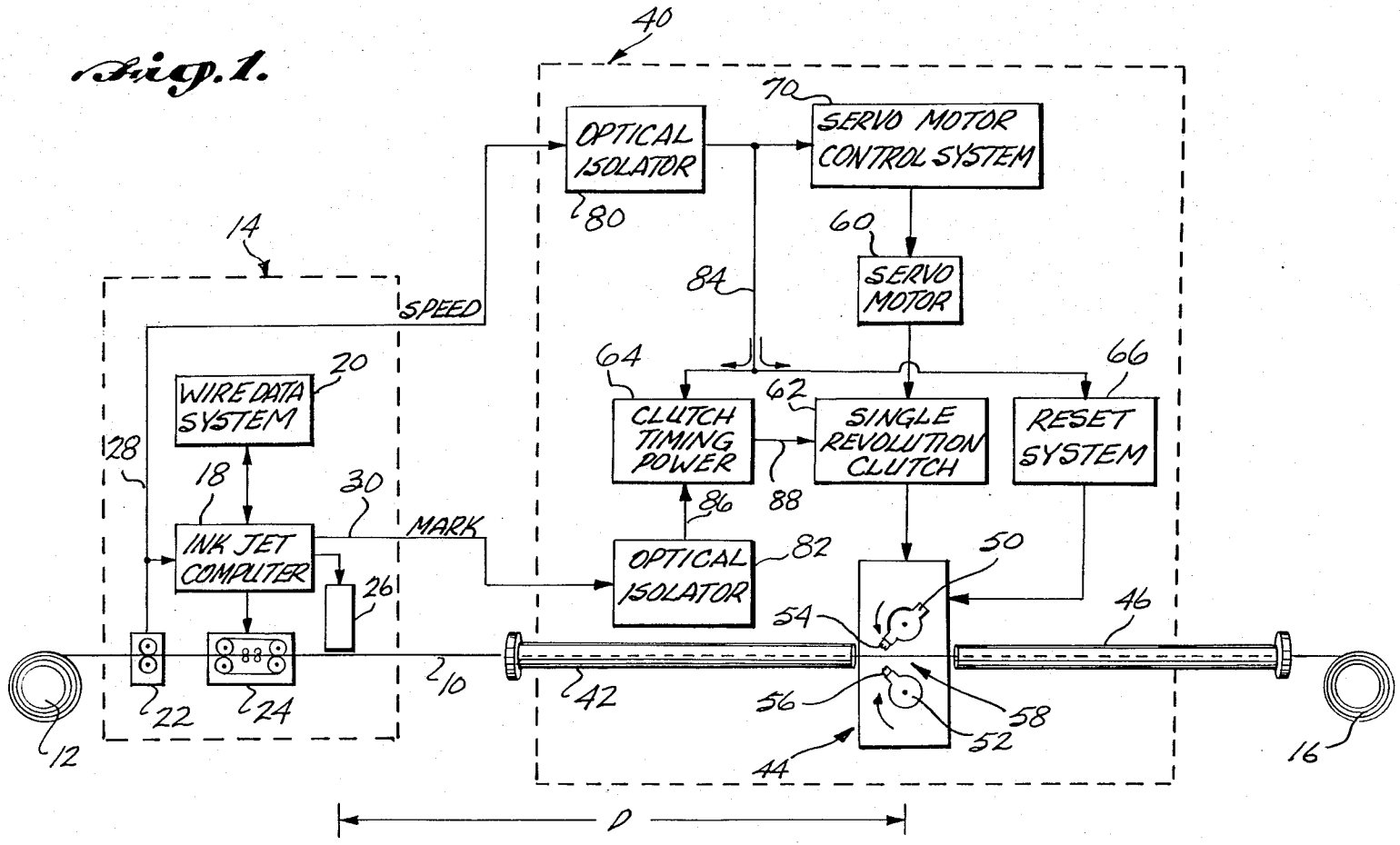
FIG. 1 is a block diagram of the pinch mark applicator of the present invention arranged for use with an ink jet marker.

One preferred arrangement for utilizing the pinch mark applicator of the present invention is shown in FIG. 1. In this arrangement, wire 10 is continuously unwound from input spool 12, passed through ink jet marker 14 and pinch mark applicator 40, and then taken up on output spool 16. Ink jet marker 14 is a known and commercially available device that uses an ink jet mechanism to mark codes and other identifying symbols on wire passing through the device. Ink jet markers are capable of handling wire speeds up to 350 feet per minute. Input spool 12 and output spool 16 are also conventional elements used in conjunction with an ink jet marker, and include the appropriate tensioning and take-up mechanisms for operating at the high speeds of which the ink jet marker is capable.

In the example shown in FIG. 1, ink jet marker 14 includes ink jet computer 18, wire data system 20, wire motion encoder 22, wire transport 24 and marking head 26. Wire data system 20 comprises a suitable memory device that contains specification data for the wire to be processed. The specification data includes the length of each wire segment together with a code associated with that wire segment. Ink jet computer 18 uses the wire specification data to correctly position marks on wire 10. In an ink jet marking operation, the operator of the ink jet marker will mount a given spool of wire as an input spool, thread the wire through the ink jet marker onto an output spool, and then indicate the wire type to the ink jet computer. In response, the ink jet computer retrieves the specification data for the wire segments corresponding to the mounted wire type, activates wire transport 24 to cause the wire to begin moving through the ink jet marker, and the proceeds to mark the wire according to the specification data. The marking is accomplished by marking head 26 under the control of the ink jet computer. The speed of the wire through the ink jet marker 14 is sensed by the wire motion encoder 22, and the wire motion encoder produces a corresponding speed signal on line 28. The speed signal comprises a series of pulses, with each pulse corresponding to a small predetermined length of wire passing through the ink jet marker.

The marks applied to wire 10 by ink jet marker 14 are of two general types: block marks and code marks. Block marks are placed between adjacent wire segments, and typically consist of two bars spaced approximately one-tenth of an inch or one character width apart. Each block mark identifies the boundary between two adjacent segments, and therefore indicates the points at which the wire should be pinched or cut. Code marks are placed within each wire segment, and serve to identify the wire segment for late processing. Each time a block mark is applied to the wire, ink jet computer 18 produces a corresponding mark signal on line 30.

In accordance with the embodiment of the invention shown in FIG. 1, wire 10 passes through pinch mark applicator 40 after exiting from the ink jet marker and prior to being taken up on output reel 16. The wire passes through the pinch mark applicator through inlet guide 42, pinch assembly 44, and outlet guide 46, the inlet and outlet guides defining a wire path for wire 10 through the pinch mark applicator. Outlet guide 46 can be moved inwardly such that its inner end abuts the inner end of inlet guide 42, to permit the initial threading of wire 10 through the pinch mark device. Pinch assembly 44 comprises co-rotating pinch members 50 and 52 that are mounted above and below the wire path respectively. Pinch members 50 and 52 include dies 54 and 56 respectively, the dies being described in greater detail below. The pinch members are intermittently actuated and co-rotated in the general mirror image fashion indicated by the arrows in FIG. 1. When the pinch members have not been actuated, the dies are at reset positions to the right of the pinch members at the 3 o'clock position. When the pinch members are actuated (as described below) to apply a pinch mark to wire 10, the pinch members rotate in concert in the directions indicated by the arrows in FIG. 1, to pinch positions in which die 54 is at the six o'clock position and die 56 is at the twelve o'clock position. In such positions, dies 54 and 56 are immediately adjacent to one another at pinch station 58, and are moving at the same speed and in the same direction as wire 10. The dies apply a pinch mark to wire 10 at the pinch station, and the pinch members then continue to rotate until the dies have returned to their reset positions.

Pinch mark device 40 includes servo motor 60, servo motor control system 70, single revolution clutch 62, clutch timing and power system 64, and reset system 66. The speed and mark signals from ink jet marker 14 are received by the pinch mark applicator via optical isolators 80 and 82 respectively, to provide corresponding speed and mark signals on lines 84 and 86 respectively. It will be appreciated that the speed signal could readily be generated by an encoder or equivalent device within the pinch mark device itself. Servo motor control system 70 receives the speed signal on line 84, and drives servo motor 60 at a selected speed with respect to the wire speed, i.e., the ratio of the servo motor speed to the speed of wire 10 is constant. Clutch timing and power system 64 receives the speed signal on line 84, and also receives the mark signal on line 86. The function of the cluth timing and power system is to actuate single revolution clutch 62, via a drive pulse on line 88, such that the single revolution clutch couples pinch assembly 44 to servo motor 60 and causes pinch members 50 and 52 to each execute one full revolution. Prior to the drive pulse, dies 54 and 56 are in their reset positions. The timing of the drive pulse on line 88 is such that the dies reach pinch station 58 at the correct time to apply a pinch mark to wire 10 upon the two bars of a block mark applied by the ink jet marker. Clutch timing and power system 64 determines the appropriate timing for the drive pulse on line 88 based upon the known distance D between marking head 26 and pinch station 58, as well as upon the speed and mark signals on lines 84 and 86 respectively. After a pinch mark has been applied, the dies return to their reset positions. As described in greater detail below, reset system 66 is provided to ensure that the dies return to their reset positions after each revolution of the pinch members.

Figure 2:
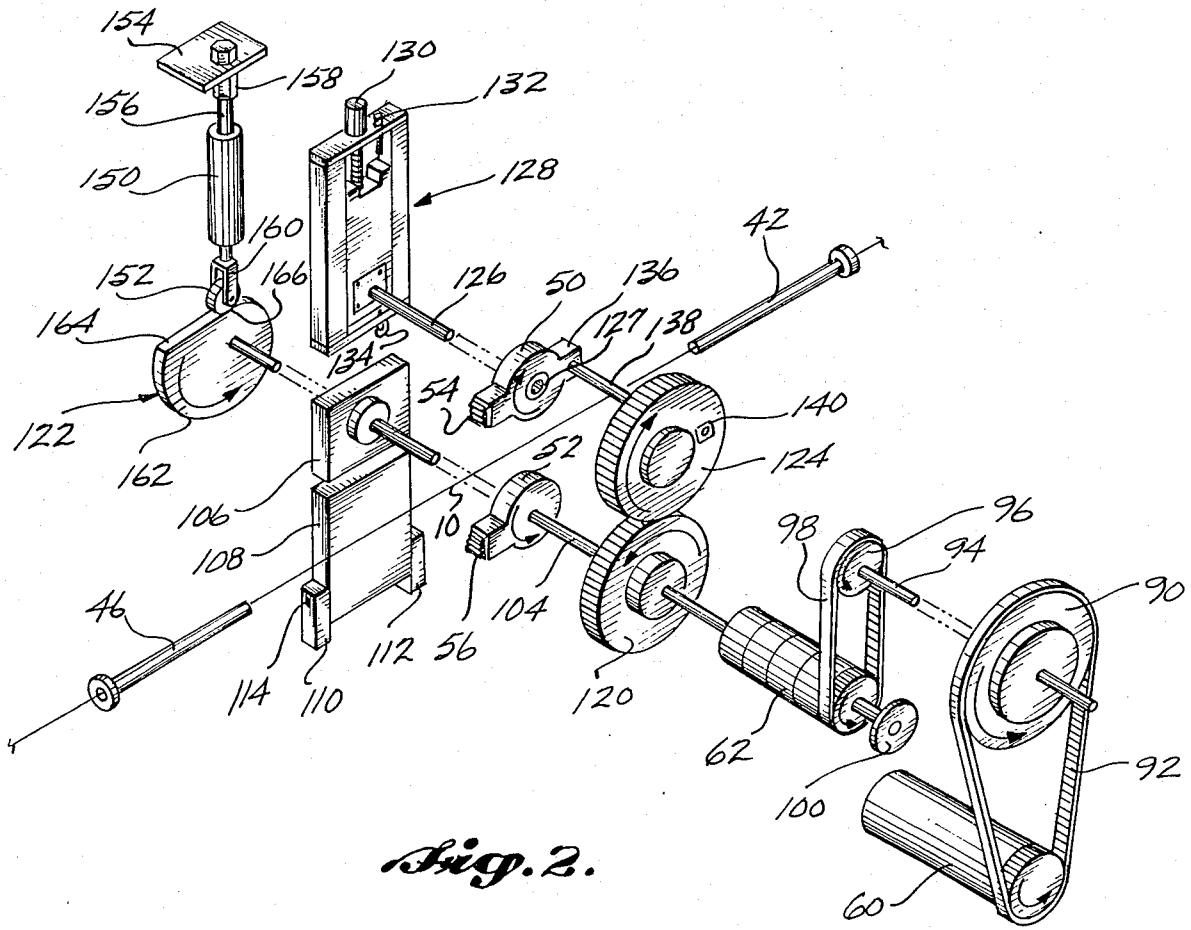
FIG. 2 is an exploded perspective view of the mechanical elements of the pinch mark applicator of FIG. 1.

A preferred mechanical arrangement of pinch mark applicator 40 is illustrated in FIG. 2. Servo motor 60 is coupled to flywheel 90 by belt 92. The flywheel is mounted on shaft 94 that also mounts pulley 96, shaft 94 being mounted by suitable bearings (not shown). Pulley 96 is coupled to the input hub of single revolution clutch 62 via belt 98. Clutch 62 is mounted between bearing 100 and bearing block 106. When wire without a block mark is passing through the pinch mark applicator, clutch 62 is disengaged, and flywheel 90 is spinning at a speed corresponding to the wire speed. The size of flywheel 90 may be adjusted based upon the particular application. In general, if the flywheel is too large, it will be unable to track variations in the speed of wire 10 during acceleration or deceleration of the wire. On the other hand if the flywheel is too small, it may limit the size (i.e., thickness) of the wire to which a pinch mark can be applied. However the flywheel could be eliminated entirely if a sufficiently powerful servo motor were employed.

Clutch 62 may comprise a conventional spring wrap clutch arranged for single revolution operation, i.e., arranged such that a level arm mounted adjacent the clutch interacts with a dog on the clutch body to permit one revolution of the clutch output shaft in response to momentary actuation of the lever. The lever in turn may be actuated by a clutch engagement solenoid described below in connection with FIG. 5. The clutch output shaft 104 is supported near its opposite end by bearing block 106. Bearing block 106 is mounted to the top of block 108 by disc springs (not shown). Block 108 is in turn pivotally mounted between lugs 110 and 112 for pivotal motion around pivot pins 114 (only one pivot pin shown). The described mounting system for block 106 simplifies the alignment and assembly of the pinch mark applicator, and also provides a safety mechanism should an oversize object become trapped between the dies. Mounted along the length of shaft 104 are lower spur gear 120, pinch member 52 and reset cam 122. Lower spur gear 120 meshes with upper spur gear 124, and the upper spur gear therefore rotates in an opposite direction from lower spur gear 120 and pinch member 52.

Pinch member 50 is mounted for rotation about shaft 126 by bearing 127, shaft 126 in turn being mounted in dove tail slide 128 such that shaft 126 is parallel to shaft 104. Dove tail slide 128 includes adjustment knob 130 for adjusting the vertical position of shaft 126, as well as upper and lower stops 132 and 134, respectively, for limiting such adjustment. Pinch member 50 includes arm 136 extending from the pinch member in a direction away from die 54. Extending from arm 136, in a direction parallel to shaft 126, is rod 138 that is received in opening 140 formed in upper spur gear 124. Opening 140 is somewhat larger than rod 138, in order to accommodate for adjustment of the position of pinch member 50 by means of adjustment knob 130 of dovetail slide 128. The upper spur gear is mounted for rotation about a shaft (not shown) that is parallel to but offset from shaft 126. By means of the described coupling, rotation of shaft 104 causes pinch members 50 and 52 to rotate in opposite directions, as indicated by the arrows on the pinch member bodies.

In a spring wrap clutch, the output shaft is disconnected from the input hub at angular positions between 315° and 360° of rotation. At comparatively high wire speeds, it has been found that sufficient angular momentum is imparted to the elements coupled to the output shaft of clutch 62 to cause shaft 104 to rotate 360° up to clutch stop point, thereby returning dies 54 and 56 to the reset positions. However, at lower wire speeds, the angular momentum of shaft 104 and elements coupled thereto may be insufficient to fully rotate the dies to the reset positions. To provide for low speed operation, the pinch mark applicator of the present invention includes a reset system that includes reset cam 122, double acting air cylinder 150, roller 152 and antirotation guide 154. Air cylinder 150 is fixed to the body of the pinch mark applicator, and includes rod 156 that has hexagonal block 158 mounted to its upper end and roller 152 mounted to its lower end via bracket 160. Block 158 is received in a hexagonal opening in guide 154, thereby preventing rod 156 and roller 152 from rotating about the longitudinal axis of the rod. Roller 152 rolls against reset cam 122, the reset cam including outwardly spiraling portion 162 and essentially linear inwardly ramping portion 164. Linear portion 164 terminates with notch 166, the position of the notch being at the reset position directly under roller 152 in FIG. 2.

When the speed of wire 10 is high, reset system 66 actuates air cylinder 150 such that rod 156 is raised, thereby moving roller 152 out of contact with reset cam 122. In this mode of operation, the reset system is inactive. However, when the speed of wire 10 drops to below a threshold level, the reset system actuates air cylinder 150 so as to cause rod 156 to move downward, such that roller 152 bears against the outer surface of the reset cam. When dies 54 and 56 are in their reset positions, roller 152 is positioned in notch 166. However, in response to actuation of clutch 62, the pinch members and reset cam rotate, and the dies pass through the pinch station. At a rotational position of about 315° past the reset position, roller 152 passes from spiral portion 162 of the reset cam to linear portion 164, thereby providing a force that continues to rotate shaft 104 until such time as notch 166 reaches roller 152. One complete rotation of shaft 104 is thus assured, even for low wire and servo motor speeds.

Figure 3:
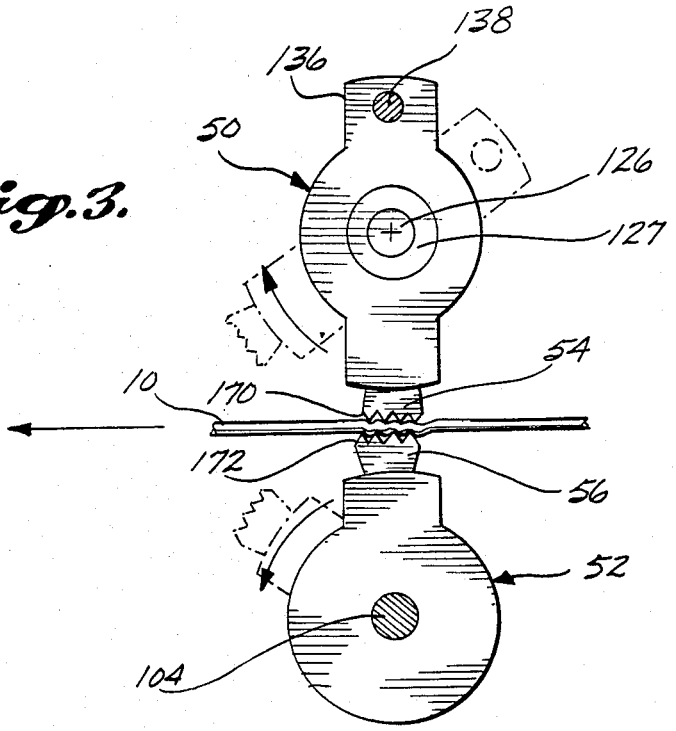
FIG. 3 is a side elevational view of the pinch members and dies.

Pinch members 50 and 52 are shown in greater detail in FIG. 3. Pinch member 50 includes arm 136 that is used to couple the pinch member to rod 138, as described above. Pinch member 50 also includes 54 opposite arm 136, and pinch member 52 includes corresponding die 56. The outer surface of die 54 comprises marking surface 170, the marking surface being formed as four triangular teeth that extend parallel to one another in a direction parallel to the pinch member rotation axis, i.e., parallel to shaft 126. Marking surface 172 on die 56 comprises a similar set of four triangular teeth. However, when the dies are at the pinched station, as illustrated in solid lines in FIG. 3, the teeth of marking surface 170 are offset from the teeth of marking surface 172, in the direction of wire 10, by a distance equal to one-half the tooth-to-tooth spacing. Each tooth of marking surface 172 is therefore aligned between adjacent teeth of marking surface 170 when the dies are at pinch station 58. This alignment may be achieved during assembly of the pinch mark applicator by mounting pinch member 52 to shaft 104 by means of a split clamping arrangement. It has been found that the described arrangement of triangular teeth creates a pinch mark that is very easy for an operator to sense, is suitable for a range of wire diameters, and does not sever the wire.

Figure 4:
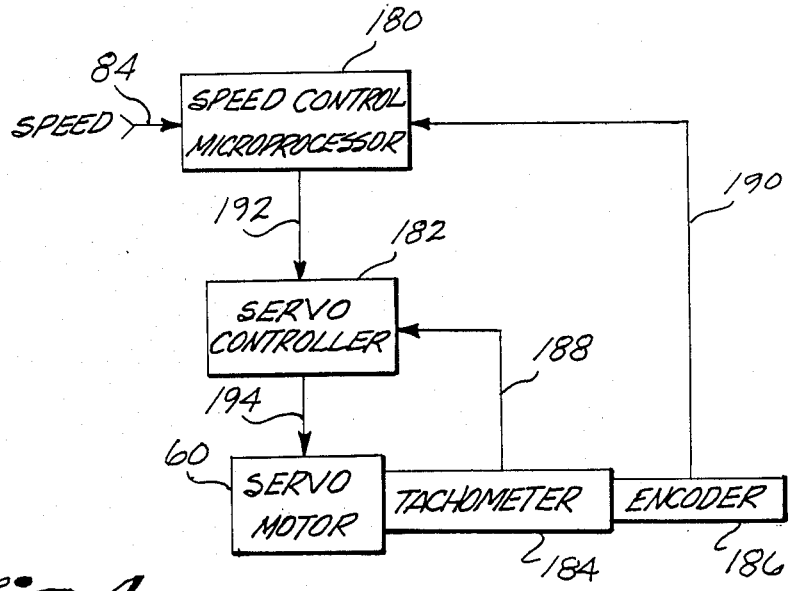
FIG. 4 is a block diagram of the servo motor control system.

Servo motor control system 70 may be implemented as illustrated in FIG. 4. The servo motor control system of FIG. 4 includes speed control microprocessor 180, servo controller 182, tachometer 184 and encoder 186. Servo controller 182 includes a power supply for driving the servo motor. Tachometer 184 and encoder 186 are mounted on the output shaft of servo motor 60. Tachometer 184 provides an analog voltage signal on line 188 that represents the speed of the servo motor. Encoder 186 provides a digital signal on line 190 that comprises a series of pulses, each pulse comprising a predetermined quantity of angular rotation of the servo motor output shaft. The pulse signal on line 190 is fed back to speed control microprocessor 180. The speed control microprocessor receives the pulse signal from encoder 186 and the speed signal from the ink jet marker via line 84, and provides an appropriate control signal for the servo controller via line 192. The speed control microprocessor controls the servo motor such that the ratio of the servo motor speed to the wire speed is a preselected constant. The speed control microprocessor accomplishes this goal by counting the pulses on lines 84 and 190, and by adjusting the control signal on line 192 such that the frequencies of the pulse trains on lines 84 and 190 bear a selected relationship to one another. For example, in one embodiment constructed in accordance with the present invention, the speed of servo motor 60 was controlled such that there were 94 pulses on line 190 for each 100 pulses on line 84. Other ratios will of course be used depending upon the gear ratios in the drive train between the servo motor and the pinch members and the radius of the pinch members measured from their centers of rotation to their respective marking surfaces, the ultimate goal being to match the speed of marking surfaces 170 and 172 at the pinch station to the speed of wire 10. Servo controller 182 receives the control signal on line 192, and compares it to the feedback signal from tachometer 184 on line 188. The conroller/power supply controls the drive signal on 194, in a conventional manner, so as to achieve the desired speed of servo motor 60.

Figure 5:
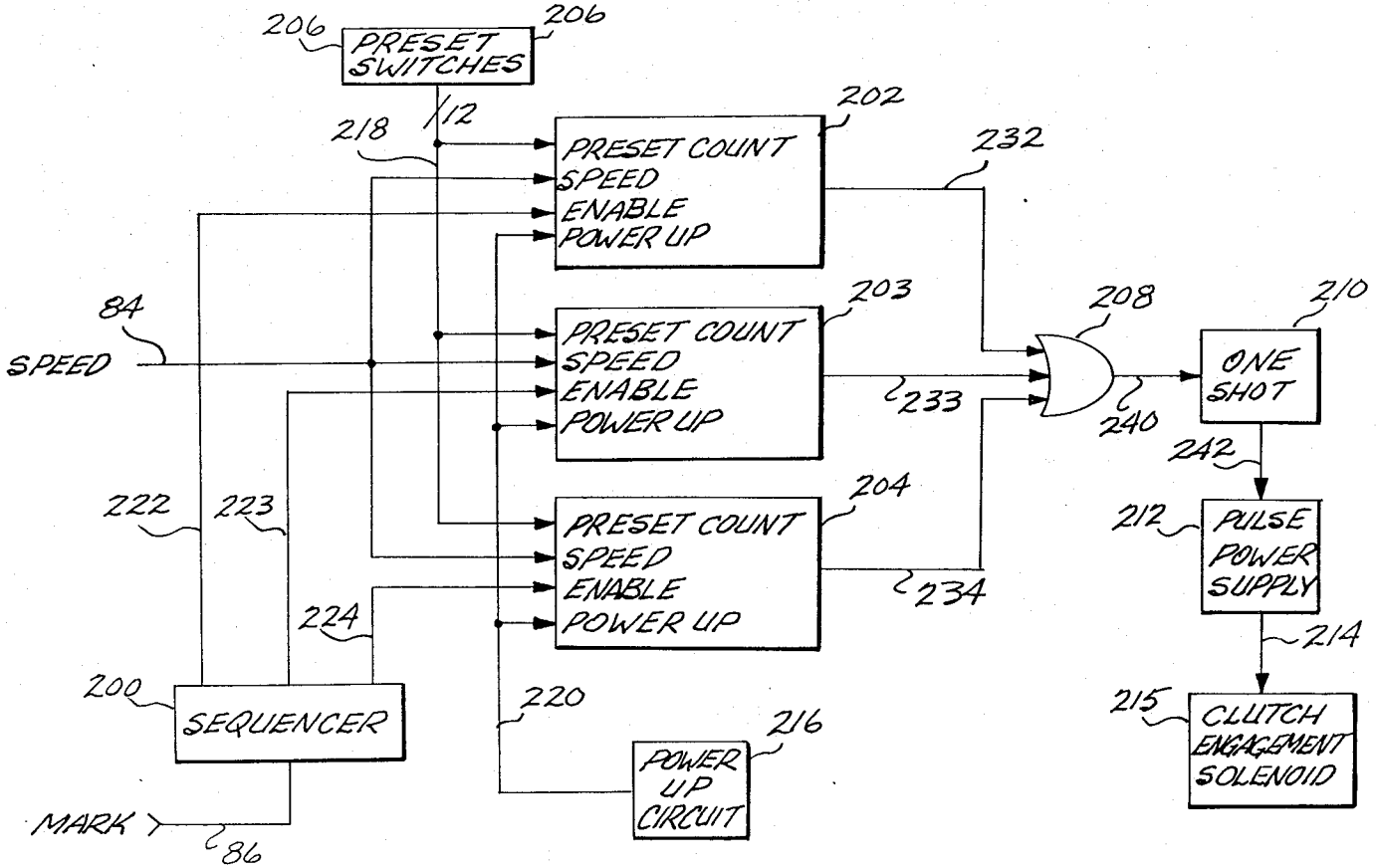
FIG. 5 is a circuit block diagram of the clutch timing and power system.
Figure 6:
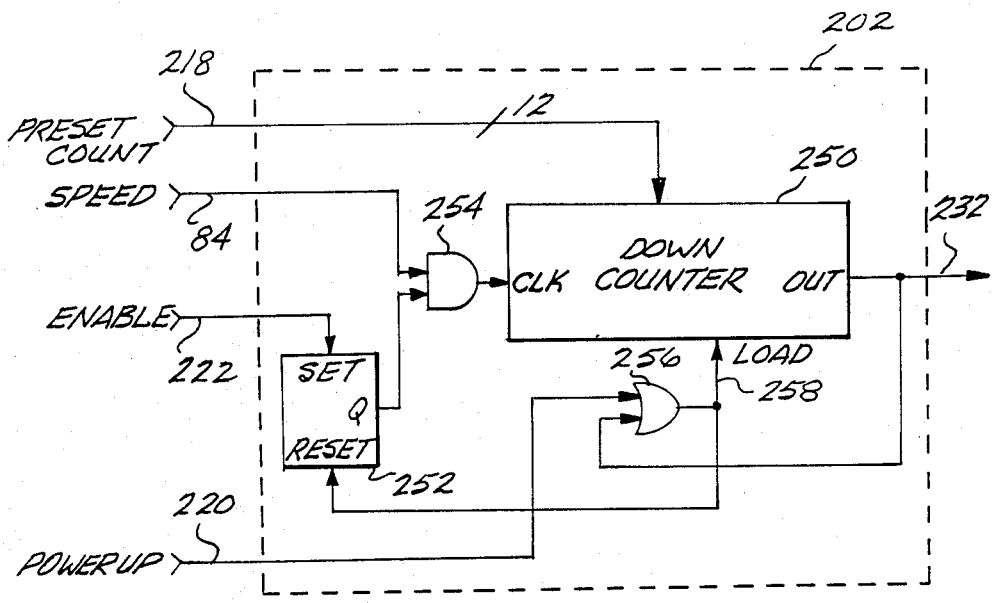
FIG. 6 is a circuit diagram of one of the count circuits.

Clutch timing and power circuit 64 is illustrated in greater detail in FIGS. 5 and 6. The clutch timing and power system comprises sequencer 200, count circuits 202–204, preset switches 206, OR gate 208, one-shot 210, pulse power supply 212, and power up circuit 216. Each count circuit is connected to receive a 12 bit signal from preset switches 206 via bus 218, as well as the speed signal on line 84 from the ink jet marker, a power up signal from power up circuit 216 via line 220, and an enable signal from sequencer 200. The enable signals are provided to count circuits 202–204 via lines 222–224, respectively. The outputs of count circuits 202–204, on lines 232–234 respectively, form the inputs to OR gate 208.

Sequencer 200 receives the mark signal on line 86 from the ink jet marker. Each time that the sequencer receives a mark signal, indicating that a block mark has been applied to wire 10 by marking head 26 (FIG. 1), the sequencer provides an enable signal to one of count circuits 202–204. The enabled count circuit has previously been loaded with a binary value, from preset switches 206, the binary value representing the disance D between marking head 26 and pinch station 58, less the circumferential distance that the dies must rotate from their reset positions to their pinch positions. Upon receipt of the enable signal, the enabled count circuit begins counting pulses of the speed signal, decrementing its count once for each speed signal pulse. When the count reaches zero, the count circuit produces an output signal that passes through OR gate 208 to one-shot 210 via line 240. As described below, the count circuit also resets itself at this time, by reloading the value stored in preset switches 206. One-shot 210 produces a pulse of predetermined length on line 242 that is received by pulse power supply 212. The pulse power supply then provides an appropriate drive pulse on line 214 to drive clutch engagement solenoid 215. Solenoid 215 pulls the lever of the single revolution clutch momentarily out of engagement with the clutch dog, thereby permitting the clutch to turn one full revolution until the dog returns to its starting position and is stopped by the lever. In order to assure prompt clutch engagement, pulse power supply 212 is preferably adapted to provide a DC voltage pulse that is considerably larger than the nominal operating voltage of the solenoid 215. For example, with a 24-volt DC clutch engagement solenoid, a suitable output voltage for pulse power supply 212 would be 180 volts.

The use of three count circuits 202–204 is required for those applications in which the ink jet marker may apply a block mark to wire 10 before the pinch mark applicator has applied a pinch mark corresponding to a prior block mark. In order to provide the ability to place block marks that are spaced apart by less than the distance D, the clutch timing and power system shown in FIG. 5 includes three count circuits 202–204, and sequencer 200 to sequentially provide enable signals to the count circuits as mark signals are received. In particular, sequencer 200 provides an enable signal on only one of lines 222–224 for each mark signal received, and cyclically switches the enabled line each time a mark signal is received. For example, if the previous mark signal resulted in an enable signal on line 222, then the next mark signal will result in an enable signal on line 223, and subsequent mark signals will result in enable-signals on line 224, then on line 222, etc.

FIG. 6 illustrates a preferred embodiment for count circuit 202. Count circuits 203 and 204 may be identical to count circuit 202. Count circuit 202 comprises binary down counter 250, flip-flop 252, AND gate 254 and OR gate 256. Each time counter 250 receives a load signal on line 258 at its load input terminal, the counter loads the preset count value from preset switches 206 via bus 218. Subsequently, receipt of an enable signal on line 222 sets flip-flop 252, and thereby enables AND gate 254 to pass the pulses of the speed signal on line 84 to the clock input (CLK) of counter 250. The counter thereupon commences counting down from the preset count towards zero. When the counter reaches zero, it produces an output signal on line 232 that results in one clutch revolution, as previously described. The signal appearing on line 232 also passes through OR gate 256 and produces a load signal on line 258 that causes counter 250 to reset itself by again loading the preset count from line 218. The signal on line 258 also resets flip-flop 252, so that another enable signal will be required before the counter begins counting down. Such a reset also occurs, for each count circuit 202–204, upon receipt of a power up signal on line 220 from power up circuit 216. It is to be understood that the number of count circuits used in the clutch timing and power system will depend upon the ratio of the minimum distance between block marks to the distance D between the marking head and the pinch station.

Figure 7:
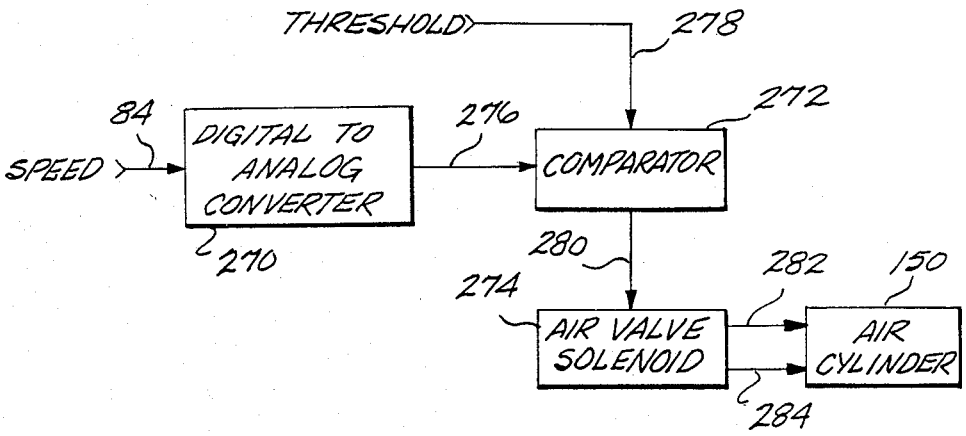
FIG. 7 is a block diagram of the reset system.

Further elements of reset system 66 are illustrated in FIG. 7. The reset system includes digital-to-analog converter 270, comparator 272 and air valve solenoid 274. The air valve solenoid controls air cylinder 150 (see FIG. 2) via pneumatic lines 282 and 284. Digital-to-analog converter 270 receives the speed signal on line 84, and produces a corresponding analog speed signal on line 276. Comparator 272 compares the analog speed signal on line 276 with an analog threshold signal on line 278. If the speed signal on line 276 exceeds the threshold signal on line 278, then comparator 272 produces a control signal on line 280 that causes the air valve solenoid to raise air cylinder 150, such that roller 152 is out of engagement with reset cam 122. However when the speed of the wire falls below the preestablished threshold, the speed signal on line 276 is smaller than the threshold signal on line 278, and the comparator produces a different signal on line 280 that results in the air cylinder rod 156 being lowered. When the air cylinder rod is lowered, the reset system is active, and roller 152 bears against reset cam 122 and forces the reset cam back to its reset position after each rotation of the pinch members.

While the preferred embodiments of the invention have been illustrated and described, it is to be understood that variations will be apparent to those skilled in the art. For example, for some applications it may be desirable to add a checking circuit to insure that the number of pinch marks applied to the wire is equal to the number of mark signals received from the ink jet marker. Such a circuit could readily be implemented by deriving a signal from a magnetic pickup that senses actuation of the dies, accumulating counts representing the number of signals from the magnetic pickup and the number of mark signals received, and by comparing such counts and activating a warning light or buzzer if they become unequal. Accordingly, the invention is not to be limited to the specific embodiments illustrated and described, and the true scope and spirit of the invention are to be determined by reference to the following claims.

The embodiments of the invention in which an exclusive property or privilege is claimed are defined as follows:

1. An apparatus for applying pinch marks at selected target positions at infinitely varying intervals along the length of a wire moving along a wire path at a wire speed, the apparatus comprising:

means for sensing the wire speed and for producing a signal indicative thereof;

means for storing wire specification data, the wire specification data defining variable lengths between pinch marks to be applied to the wire;

means responsive to the signal indicative of wire speed and to the wire specification data for producing a series of first signals representing respective target positions where pinch marks will be applied at varying intervals along the wire;

pinch means, including a die mounted for movement to and from a pinch station along the wire path, the die being adapted when at the pinch station to apply a pinch mark to the wire; and, coupling means responsive to the first signals and thus to the wire speed, for causing the die to move to the pinch station such that the die is at the pinch station when each target position on the wire is at the pinch station, producing a variable length between pinch marks, said variable length being dependent upon the first signals.

2. The apparatus of claim 1, wherein the coupling means includes means for controlling the movement of the die to the pinch station such that the die arrives at the pinch station moving at substantially the same speed as the wire.

3. The apparatus of claim 2, wherein the coupling means comprises a servo motor, control means for driving the servo motor at a selected speed with respect to the wire speed, and engagement means responsive to the first signal for coupling the die to the servo motor such that the target position and the die arrive at the pinch station at substantially the same time and moving at substantially the same speed.

4. The apparatus of claim 2, wherein the coupling means comprises single revolution clutch means and timing means for actuating the clutch means for a single revolution, the timing means being operative to begin timing upon receipt of the first signal for a duration dependant on the signal indicative of wire speed, and for actuating the clutch means at the end of said duration.

5. The apparatus of claim 4, wherein the coupling means includes reset means for returning the die to a predetermined reset position after each revolution of the clutch means.

6. The apparatus of claim 5, wherein the reset means includes activation means for activating the reset system when the wire speed is below a predetermined threshold and for deactivating the reset system when the wire speed is above said threshold.

7. The apparatus of claim 4, wherein the timing means comprises a counter for storing a variable count value, means for loading the counter with a preset count value, means responsive to the receipt of the first signal to enable the counter to vary the count value at a rate corresponding to wire speed, and means responsive to the count value reaching a predetermined value for actuating the clutch means.

8. The apparatus of claim 7, wherein the timing means comprises a plurality of counters for storing a corresponding plurality of variable count values, and means for sequentially providing an enable signal to the counters upon the receipt of sequential first signals, each counter including means for loading the counter with the preset count value, means responsive to the enable signal to enable the counter to vary the count value at a rate corresponding to the wire speed, and means responsive to the count value reaching a predetermined value for actuating the clutch means.

9. The apparatus of claim 1, wherein the pinch means comprises first and second pinch members mounted for rotation about spacedapart, parallel axes, the first and second pinch members including respective first and second dies positioned such that each die is at the pinch station at one rotational position of the associated pinch member, the pinch means further comprising means coupling the rotation of the pinch members such that one die is at the pinch station when the other die is at the pinch station.

10. The apparatus of claim 9, wherein each die comprises a plurality of linearly elongated teeth having triangular cross sections, the teeth of the first and second dies being mounted such that when the dies are at the pinch station, the teeth of the first die are offset from the teeth of the second die along the length of the wire by a distance approximately equal to half of the spacing between adjacent teeth of one of the dies.

11. The apparatus of claim 9, wherein the coupling means comprises a servo motor, control means for driving the servo motor at a selected speed with respect to the wire speed, and engagement means responsive to the first signal for coupling the first and second pinch members to the servo motor such that the target position and dies arrive at the pinch station at the same time and moving at substantially the same speed in the same direction.

12. The apparatus of claim 11, wherein the coupling means comprises a first shaft upon which the first pinch member is rigidly mounted and a first spur gear mounted to the first shaft, the engagement means being operative to couple the first shaft to the servo motor in response to the first signal, the apparatus further comprising a second spur gear mounted to mesh with the first spur gear, and means coupling the second spur gear to the second pinch member such that the second pinch member rotates when the first pinch member rotates.

13. The apparatus of claim 12, wherein the coupling means comprises a second shaft upon which the second pinch member is pivotally mounted for rotation about a pivot axis parallel to and offset from the second shaft, an arm extending radially outward from the pivot axis, and means coupling the arm to the second spur gear.

14. The apparatus of claim 13, wherein the second spur gear includes an opening extending through the second spur gear in a direction parallel to the axis of rotation of the second spur gear, and wherein the means coupling the second pinch member to the second spur gear comprises a rod extending from said arm in a direction parallel to said pivot axis, the arm being received in the opening and having a cross section smaller than the cross section of the opening.

15. The apparatus of claim 13, wherein the coupling means includes means for adjusting the position of the second shaft towards and away from the first shaft to adjust the spacing between the dies at the pinch station.

16. An apparatus for applying a pinch mark at a selected target position along the length of a wire moving along a wire path at a wire speed, in response to a first signal indicative of the target position, the apparatus comprising:

pinch means including a die mounted for movement to and from a pinch station along the wire path, the die being adapted when at the pinch station to apply a pinch mark to the wire, the pinch means further comprising first and second pinch members mounted for rotation about spaced-apart, parallel axes, the first and second pinch members including respective first and second dies positioned such that each die is at the pinch station at one rotational position of the associated pinch member, and means coupling the rotation of the pinch members such that one die is at the pinch station when the other die is at the pinch station; and, coupling means responsive to the first signal for causing the die to move to the pinch station such that the die is at the pinch station when the target position on the wire is at the pinch station, the coupling means further comprising a servo motor, control means for driving the servo motor at a selected speed with respect to the wire speed, engagement means responsive to the first signal for coupling the first and second pinch members to the servo motor such that the target position and dies arrive at the pinch station at the same time and moving at substantially the same speed and the same direction, a first shaft upon which the first pinch member is rigidly mounted and a first spur gear mounted to the first shaft, the engagement means being operative to couple the first shaft to the servo motor in response to the first signal, a second spur gear mounted to mesh with the first spur gear, and means coupling the second spur gear to the second pinch member such that the second pinch member rotates when the first pinch member rotates, a second shaft upon which the second pinch member is pivotally mounted for rotation about a pivot axis parallel to and offset from the second shaft, an arm extending radially outward from the pivot axis, and means coupling the arm to the second spur gear.

17. The apparatus of claim 16, wherein the second spur gear includes an opening extending through the second spur gear in a direction parallel to the axis of rotation of the second spur gear, and wherein the means coupling the second pinch member to the second spur gear comprises a rod extending from said arm in a direction parallel to said pivot axis, the arm being received in the opening and having a cross section smaller than the cross section of the opening.

18. The apparatus of claim 16, wherein the coupling means includes means for adjusting the position of the second shaft towards and away from the first shaft to adjust the spacing between the dies at the pinch station.

19. An apparatus for applying a pinch mark at a selected target position along the length of a wire moving along a wire path at a wire speed, in response to a first signal indicative of the target position, the apparatus comprising:

pinch means including a die mounted for movement to and from a pinch station along the wire path, the die being adapted when at the pinch station to apply a pinch mark to the wire; and, coupling means responsive to the first signal for causing the die to move to the pinch station such that the die is at the pinch station when the target position on the wire is at the pinch station, said coupling means includes means for controlling the movement of the die to the pinch station such that the die arrives at the pinch station moving at substantially the same speed as the wire, said coupling means further comprising single revolution clutch means and timing means for actuating the clutch means for a single revolution, the timing means being operative to begin timing upon receipt of the first signal for a duration dependent on a second signal indicative of the wire speed, and for actuating the clutch means at the end of said duration, and including reset means for returning the die to a predetermined reset position after each revolution of the clutch means, said reset means including activation means for activating the reset system when the wire speed is below a predetermined threshold and for deactivating the reset system when the wire speed is above said threshold.

20. An apparatus for applying pinch marks at selected target positions at infinitely variable intervals along the length of a wire moving along a wire path at a wire speed, in response to a first signal indicative of the target positions determined as a function of digitally encoded wire specification data and a second signal indicative of the wire speed, the apparatus comprising:

means responsive to the wire specification data for applying a code to the wire indicating its use;

pinch means including a die mounted for movement to and from a pinch station along the wire path, the die being adapted when at the pinch station to apply a pinch mark to the wire marking a section of the wire to which the code corresponding to that section is applied; and,

* * * * *

UNITED STATES PATENT AND TRADEMARK OFFICE

CERTIFICATE OF CORRECTION

PATENT NO. : 4,854,147

DATED : August 8, 1989

INVENTOR(S) : Buckwitz et al.

It is certified that error appears in the above-identified patent and that said Letters Patent is hereby corrected as shown below:

| Column | Line | Error |
|---|---|---|
| 1 | 31 | "numer" should be --number-- |
| 2 | 33 | "for" should be --of-- |
| 4 | 20 | "the" should be --then-- |
| 5 | 64 | "level" should be --lever-- |
| 8 | 33 | "disance" should be --distance-- |
| 9 | 8 | "enable-" should be --enable-- |
| 11 | 22 | "spacedapart" should be --spaced-apart-- |
| 14 | 22 | After "; and," insert last paragraph --coupling means responsive to the first signal for causing the die to move to the pinch station such that the die is at the pinch station when the target position on the wire is at the pinch station, said coupling means including means for controlling the movement of the die to the pinch station such that the die arrives at the pinch station moving at substantially the same speed as the wire, said coupling means further comprising clutch means and timing means for actuating the clutch means, the timing means being operative to begin timing upon receipt of the first signal for a duration dependent on the second signal, and further operative to actuate the clutch means at the end of said duration so that pinch marks are applied to the wire at varying intervals dependent upon the first signal, as determined by the wire specification data.-- |

Signed and Sealed this

Ninth Day of October, 1990

*Attest:*

HARRY F. MANBECK, JR.

*Attesting Officer*

*Commissioner of Patents and Trademarks*